US005361413A

United States Patent [19]

Schaefer

[11] Patent Number: 5,361,413

[45] Date of Patent: Nov. 8, 1994

[54] BOW TIE

[76] Inventor: Aaron M. Schaefer, 1415 N. Brand Blvd., No. H, Glendale, Calif. 91202

[21] Appl. No.: 711,219

[22] Filed: Jun. 6, 1991

[51] Int. Cl.[5] ..... A41D 25/08; A41D 25/00

[52] U.S. Cl. ..... 2/144; 2/151; 2/154; 2/155

[58] Field of Search ..... 2/149, 151, 154, 155, 2/157, 144, 146, 148

[56] References Cited

U.S. PATENT DOCUMENTS

| | | | |
|---|---|---|---|
| 387,231 | 8/1888 | Harrison, Jr. | 2/151 X |
| 460,259 | 9/1891 | Bartlett | 2/151 X |
| 1,373,949 | 4/1921 | Chaundy | 2/151 |
| 1,456,757 | 5/1923 | Berkson | 2/151 |
| 1,457,559 | 6/1923 | Stonge | 2/155 X |
| 1,540,037 | 6/1925 | Smith . | |
| 1,692,991 | 11/1928 | Howard . | |
| 1,737,072 | 11/1929 | Blach | 2/151 |
| 2,045,279 | 6/1936 | Mayer | 2/155 |
| 2,045,280 | 6/1936 | Mayer | 2/155 |
| 2,061,630 | 11/1936 | Keys | 2/155 |
| 2,578,269 | 12/1951 | Sinton | 2/151 |
| 3,034,134 | 5/1962 | Peterson | 2/151 |
| 4,183,098 | 1/1980 | Knowles, Jr. | 2/16 |
| 4,472,839 | 9/1984 | Johansen | 2/DIG. 6 X |
| 4,856,115 | 8/1989 | Knapp | 2/155 |
| 4,977,622 | 12/1990 | Schley | 2/16 X |
| 4,999,853 | 3/1991 | Tanner | 2/DIG. 6 X |

*Primary Examiner*—Jeanette E. Chapman
*Attorney, Agent, or Firm*—Wagner & Middlebrook

[57] ABSTRACT

Herein is described an invention comprising an adjustable bow tie of three basic parts: a bow strip, a bow loop and a neck band. The bow strip may be pre-tied or otherwise, and is held in a bow shape by a tubular bow loop, located in the center of the tied bow strip. The neck band is separable from the bow tie portion and has an unrestricted path through the bow loop. The neck band is adjustable to the size of the wearer's neck and employs hook and pile fabric fasteners adjacent to both ends of the band and located longitudinally along opposite sides of the band. The combination of the fastening means with the unrestricted movement of the neck band allows the wearer to adjust the band and conceal such adjustment and the fastening means from view.

4 Claims, 2 Drawing Sheets

FIG. 1
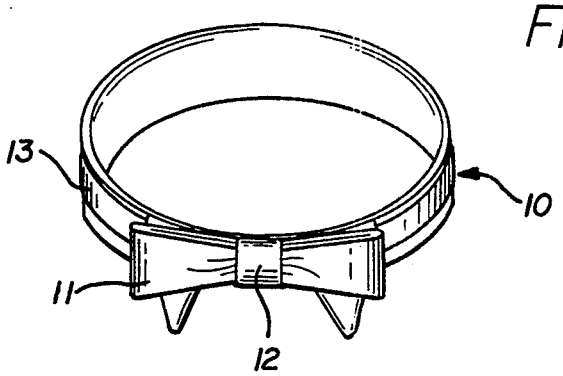
FIG. 2
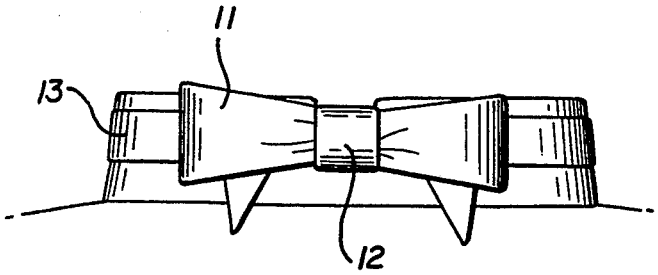
FIG. 3
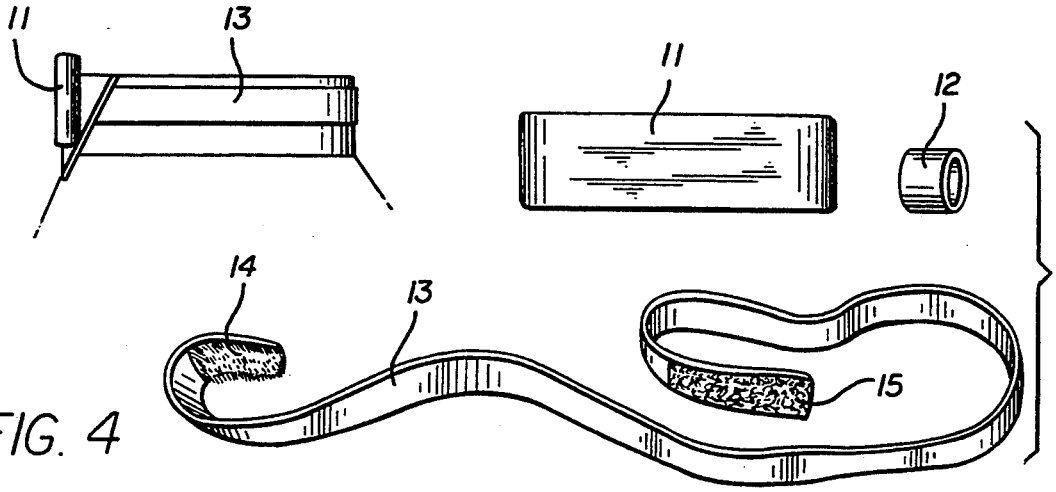
FIG. 4
FIG. 4A
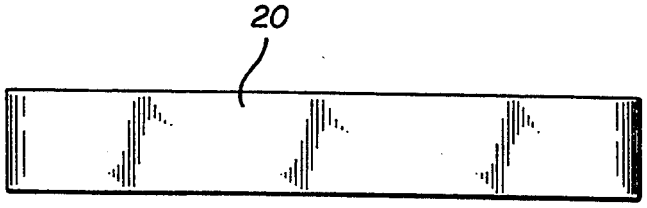

FIG. 5
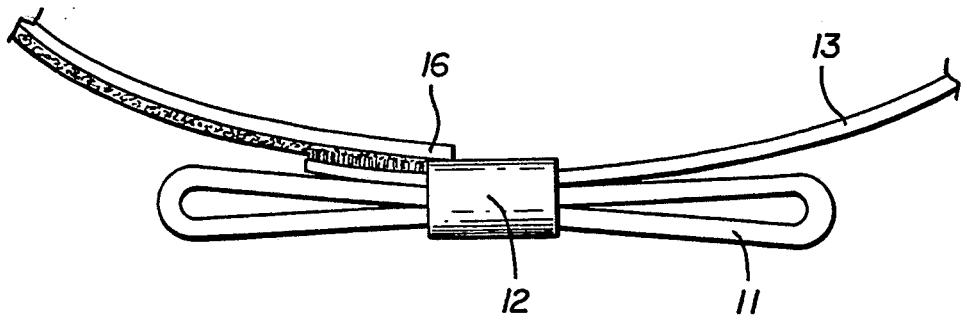
FIG. 6
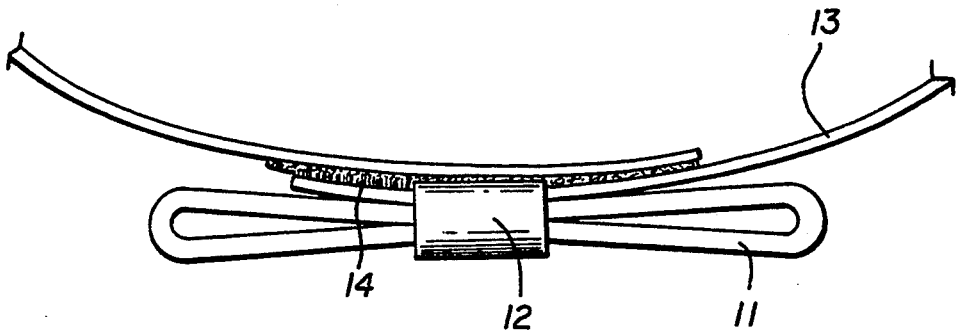
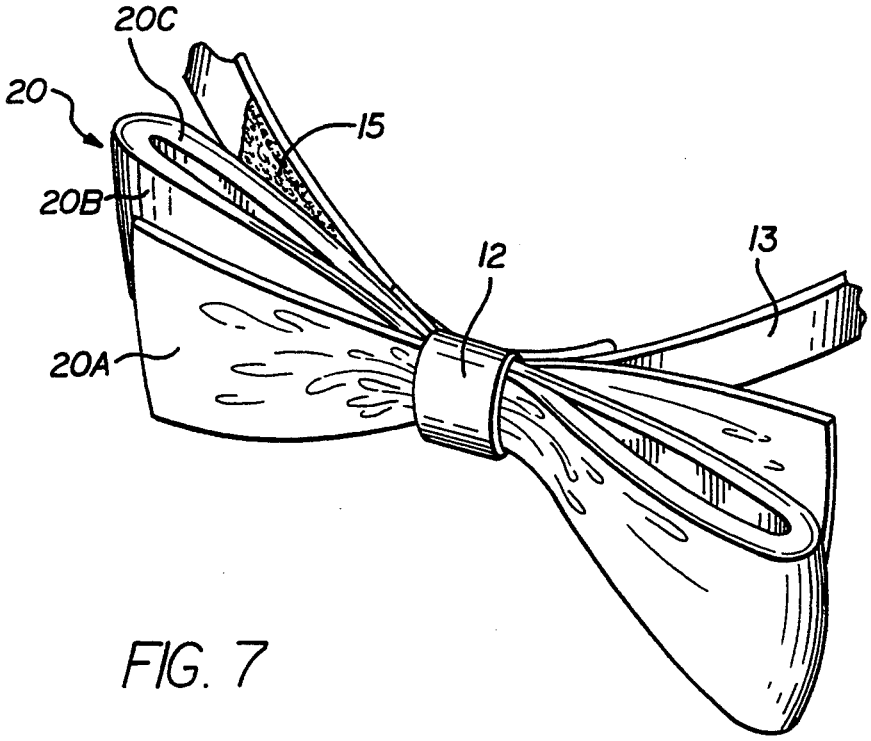
FIG. 7

BOW TIE

BACKGROUND OF THE INVENTION

For centuries the bow tie has been an important part of the male haberdashery particularly for formal affairs. It also finds a smaller but real part of casual clothing, female apparel and often a part of waiters and other service personnel's garb. There is no doubt that it forms a final attractive garment detail particularly when worn with a wing type collar where it is virtually totally exposed.

One of the banes of wearer's existence is the procedure for adjusting the size and neatly tying the bow tie. This has given acceptance to the pretied bow tie using a hook and multiple button hole type slots to connect the ends of the strap and to make size adjustments. Unfortunately, these adjustment features are totally exposed when the bow tie is worn with a wing collar and even under conventional collar produces an unsightly bulge usually at the side of the wearer's collar.

The pretied bow tie also often presents such a regular appearance that it gives away the fact that it is pretied.

Various attempts have been made to overcome the above mentioned problems of bow ties but none have been accepted and these problems remain unsolved. Also the bow tie when worn by service personnel on a regular or daily basis, the need to clean the bow tie easily becomes important. Metal parts such as the hook can become rusted if the tie is washed or damaged if the tie is pressed. The common practice is seldom or never to clean bow ties.

BRIEF DESCRIPTION OF THE INVENTION

I have been a regular wearer of bow ties for many years and have personally noted each of the above disadvantages. I also am well aware of the effective use of hook and pile type fabric fasteners for apparel such as belts, shoes and jackets. These are often called by the trademark "VELCRO" fasteners.

It occurred to me that some of the problems of bow tie construction might be solved if hook and pile type fasteners were somehow combined with a bow tie. Unfortunately hook and pile fasteners themselves are often unsightly, provide bulges themselves and often are not reliable. They do provide a degree of adjustability but in the process usually have a length of unwanted overhang.

I determined that to merely substitute a hook and pile fastener at the side of a bow tie band for the traditional metal hook and slot would provide no improvement. In fact, the hook and pile fastener would provide an even larger bulge and unwanted overhang.

It occurred to me that a hook and pile fastener could be compatible with a bow tie if it provided adjustability with concealment under the bow tie itself without any bulge showing and with some provision for concealment of any overhang length of the hook and pile fastener.

Likewise, I determined that I could achieve the attractive yet casual appearance of the self tied tie with a pretied tie while totally concealing the fastener and producing no visible bulges around the collar.

Since hook and pile fasteners plus many tie materials are washable and hold their shape without ironing, I can provide an easily cleaned bow tie.

Also, in accordance with my invention the neck band and bow are separable so that they may be of different colors or patterns, if desired and interchangeable.

Briefly, my invention involves a bow tie of three basic parts, the bow strip, the loop and the neck band. The bow strip is basically a rectangular double thickness fabric length which is foldable lengthwise into two or three lengths to form a bow. The loop is a fabric tube in the order of $\frac{1}{2}$ to $\frac{5}{8}$" in diameter and length to compress the central portion of the bow strip to form the bow. In pretied versions, the tube is stitched to the folded bow strip with an unobstructed path through the tube at the rear or inner side of the bow for the neck band.

In self tied versions, the tube and bow strip are separate.

The neck band is a length of fabric of $\frac{1}{2}$-$\frac{3}{4}$" in width and 12" to 14" in length for small necks, 14" to 16" in length for medium necks and 16" to 18" in length for larger necks. One end of the neck band includes a hook type fabric fastener material for approximate 1". The end may be tapered to a point to facilitate the insertion of the end through the tube. The hook type fastener also stiffens this end to aid in its passage through the tube.

The opposite end of the neck band includes approximately $1\frac{1}{2}$" of pile type fastener on the opposite face from the hook type fastener. Together the fastener parts provide approximately 2" of neck band adjustment with overhang at one or the other end, providing an effective fastener range.

According to my invention, the overhang portion which is present in all adjustment positions within the range of the proper sizing of the neck band, provides a slot between the wearer's neck and the tube to engage the tube when the fastener portion, after engagement is slipped around until it rests in the tube portion. In all such degrees of adjustment it is fully concealed behind the bow.

BRIEF DESCRIPTION OF THE DRAWING

This invention may be more clearly understood from the following detailed description and by reference to the drawing in which:

FIG. 1 is a perspective view of a bow tie of this invention on a wing collar;

FIG. 2 is a front elevational view thereof;

FIG. 3 is a side elevational view thereof;

FIG. 4 is an exploded view of my invention;

FIG. 4A is a plan view of the longer bow portion;

FIG. 5 is a top plan view of my invention with maximum size adjustment;

FIG. 6 is a top plan view of my invention with a minimum size adjustment; and FIG. 7 is a fragmentary perspective view of an alternate embodiment of my invention with a self tied triple length bow.

DETAILED DESCRIPTION OF THE INVENTION

Referring now to FIGS. 1 through 4, a bow tie 10 employing my invention may be seen. It comprises basically three parts which may be totally separate or sewn together depending upon the requirements of the wearer. The portions are a bow portion 11 which is basically a rectangular length of double thickness fabric with concealed seams. The bow portion may be typically $1\frac{1}{2}$" in width and 4" to 6" inches in length. Black satin for formal attire is customary and silk, wool or leather are common other fabrics used for the bow.

The second portion of the bow tie is a tubular length 12 of fabric, usually matching the bow portion in color and fabric. It is typically ½ to ⅝" in tube diameter and length, as well. It may be formed by taking a length of ribbon and sewing the ends together. The tubular portion may be sewn to the bow portion in pretied versions of this invention.

The third portion of the bow tie is the neck band 13 which is a length of ribbon like material which may vary in length from 14" to 18". At one end of the band 13 is a length of hook type fabric fastener 14, commonly referred to by the trademark "VELCRO". The hook type fastener 14 shown in FIGS. 4–7 may be sewn or attached to the neck band 13 by adhesive but the former is preferred. Note as an important feature of this invention that the fastener 14 is not visible as worn and as seen in FIGS. 1–3.

One end of the neck band 13 may be tapered to facilitate its insertion into and through the tubular portion 12.

The opposite end and opposite side of the neck band 13 has a length of mating pile fastener 15 secured to the neckband by sewing or adhesive. One of the lengths of hook and pile fastener 14 or 15 is preferably longer than the other to provide a greater extent of adjustability to the length of the neckband 13 when worn. The difference in length also provides an overhang portion 16 which is used to position the fastener portions 14 and 15 behind the bow portion and to conceal it and effectively lock it in place.

Although the neck band 13 and tubular portion 12 may be sewn to the bow portion 12, in the preferred embodiment they are each separate thereby affording the greatest degree of versatility to this invention. Particularly, the neck band 13, if separate but extending through the tubular portion 12, may be slipped on the collar at any position, adjusted to comfortable length and then slid around to be concealed totally behind the bow portion 11. The bulge or adjusting hook normally visible in the best available bow ties are gone. The size adjustment with the proper length of neck band precise and concealment is complete by the interlocking of the overhang portion of the hook and pile fastener portion with the tubular portion 12, as stated above. Only the top views FIGS. 5 and 6, which are never seen by companions of the wearer, show the hook and pile fastener.

FIG. 5 indicates an approximate limit for the length of the particular neck band used. Should one's neck be larger, the overhang 16 will be too small to capture the tubular portion 12. At the same time, the Velcro portion 15 will be clearly visible at the side of the bow, which is not desirable. This indicates that the next size longer neck band is required.

FIG. 6 shows the approximate minimum limit on the size of one's neck that will provide proper fit. With any greater overlap the Velcro® portions would not contact each other and a shorter neck band would be indicated.

FIG. 7 shows a self tied version employing the longer bow portion 20 of FIG. 4A when it is folded into three lengths. 20A, 20B and 20C.

The above described embodiments of the present invention are merely descriptive of its principles and are not to be considered limiting. The scope of the present invention instead shall be determined from the scope of the following claims including their equivalents.

What is claimed is:

1. A bow tie comprising:

a bow portion comprising a generally rectangular length of fabric folded to define a bow proper of a desired length;

a tubular portion for encircling a central region of said bow portion to define a constricted central region of the bow;

a neck band portion comprising an elongated length of fabric;

said neck band portion including mating hook and pile fabric fastener portions at opposite ends and opposite sides of said neck band portion;

said hook and pile fabric fastener portions being of different lengths at least one of which is greater than the length of said tubular portion, the effective fastening range of said hook and pile fabric fastener portions at least equalling the length of the shorter of said hook and pile fabric fastener portions;

said neck band portion being slidable through said tubular portion to allow said hook and pile portions to engage each other and secure said neck band with said hook and pile portions being fully concealed behind said bow and whereby a portion of one of said hook and pile fastener portions is caused to engage said tubular portion and act as a restraint to movement of said tubular portion with respect to said neck band and effectively lock said tubular member to said neck band.

2. A bow tie in accordance with claim 1 wherein said tubular portion has an unrestricted path therethrough to receive an end of said neck band in slidable relationship with said bow portion; and said hook and pile fabric fastener portions has a length less than the length of the bow portion whereby said fastener portions are concealed behind said bow portion.

3. A bow tie in accordance with claim 1 wherein said bow portion is permanently folded and said tubular portion is secured about the central portion thereof to provide a pretied bow.

4. A bow tie in accordance with claim 1 wherein said neck band portion is in slidable removable relationship with said tubular portion.

* * * * *